US009488168B2

(12) United States Patent
Pursifull

(10) Patent No.: US 9,488,168 B2
(45) **Date of Patent: *Nov. 8, 2016**

(54) METHOD AND SYSTEM FOR PRIORITIZING VEHICLE VACUUM

(71) Applicant: Ford Global Technologies, LLC, Dearborn, MI (US)

(72) Inventor: Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 148 days.

This patent is subject to a terminal disclaimer.

(21) Appl. No.: 14/492,649

(22) Filed: Sep. 22, 2014

(65) Prior Publication Data

US 2015/0013652 A1 Jan. 15, 2015

Related U.S. Application Data

(63) Continuation of application No. 13/050,700, filed on Mar. 17, 2011, now Pat. No. 8,857,165.

(51) Int. Cl.

| | |
|---|---|
| ***F04B 47/00*** | (2006.01) |
| ***F04B 49/03*** | (2006.01) |
| ***F02B 47/00*** | (2006.01) |
| *F02D 9/02* | (2006.01) |

(52) U.S. Cl.

CPC ..... *F04B 49/03* (2013.01); *F02B 47/00* (2013.01); *F02D 2009/024* (2013.01); *F02D 2009/0266* (2013.01)

(58) Field of Classification Search

CPC .. F04B 49/03; F02B 47/00; F02D 2009/024; F02D 2009/0266

See application file for complete search history.

(56) References Cited

U.S. PATENT DOCUMENTS

| | | | |
|---|---|---|---|
| 6,120,414 | A | 9/2000 | Endo et al. |
| 6,347,608 | B1 | 2/2002 | Hara et al. |
| 6,568,175 | B2 | 5/2003 | Izumiura et al. |
| 6,735,942 | B2 | 5/2004 | Wild et al. |
| 6,773,374 | B2 | 8/2004 | Ogawa et al. |

(Continued)

FOREIGN PATENT DOCUMENTS

| | | | |
|---|---|---|---|
| CN | 201730701 | U | 2/2011 |
| JP | 2005171925 | A | 6/2005 |
| WO | 2008084311 | A1 | 7/2008 |

OTHER PUBLICATIONS

Anonymous, "A Combined Aspirator With an Integrated Dual Check Valve Assembly," IPCOM No. 000239163, Published Oct. 17, 2014, 2 pages.

(Continued)

*Primary Examiner* — Logan Kraft

(74) *Attorney, Agent, or Firm* — Julia Voutyras; Alleman Hall McCoy Russell & Tuttle LLP

(57) ABSTRACT

A vacuum prioritization system for a vehicle is disclosed. In one example, use and availability of vacuum provided via vacuum sources is allocated to higher priority vacuum operated actuators when a pressure in the vacuum system exceeds a threshold pressure. The lower priority vacuum operated actuators have access to vacuum supplied via the vacuum sources when pressure in the vacuum system is less than a threshold pressure. The approach may allow higher priority actuators to operate for an extended amount of time.

19 Claims, 7 Drawing Sheets

(56) References Cited

U.S. PATENT DOCUMENTS

| | | | |
|---|---|---|---|
| 7,216,479 | B2 | 5/2007 | Tamura |
| 8,087,397 | B2 | 1/2012 | Cunningham et al. |
| 8,474,364 | B2 | 7/2013 | Wu et al. |
| 8,483,934 | B2 | 7/2013 | Cunningham et al. |
| 8,683,800 | B2 | 4/2014 | Cunningham et al. |
| 2007/0063579 | A1 | 3/2007 | Carlsson |
| 2008/0267789 | A1 | 10/2008 | Hirooka |
| 2011/0132311 | A1 | 6/2011 | Pursifull et al. |
| 2011/0203269 | A1 | 8/2011 | Karnik et al. |
| 2012/0237365 | A1 | 9/2012 | Ulrey et al. |
| 2012/0237368 | A1 | 9/2012 | Pursifull et al. |

OTHER PUBLICATIONS

Partial Translation of Office Action of Chinese Application No. 2012100730274, Issued October Jul. 2, 2015, State Intellectual Property Office of PRC, 9 Pages.

METHOD AND SYSTEM FOR PRIORITIZING VEHICLE VACUUM

CROSS REFERENCE TO RELATED APPLICATIONS

The present application is a continuation of U.S. patent application Ser. No. 13/050,700, "METHOD AND SYSTEM FOR PRIORITIZING VEHICLE VACUUM," filed on Mar. 17, 2011, the entire contents of which are hereby incorporated by reference for all purposes.

BACKGROUND/SUMMARY

Vacuum may be used in vehicles to operate or to assist in the operation of vehicle brakes, ventilation systems, and other actuator devices. However, for engines that are boosted and that have relatively small displacement, it may be difficult to supply vacuum to all vacuum consumers (e.g., vacuum operated actuators such as turbocharger waste gate actuators, vehicle ventilation controls, and brake boosters) of the vehicle. For example, if an engine is operating at boosted conditions for a period of time, and at the same time vacuum is being consumed by vacuum consumers, the amount of vacuum in the vacuum system may be reduced to an extent that operation of one or more vacuum operated actuators may be degraded.

The inventors herein have recognized the above-mentioned disadvantages and have developed a vacuum prioritization method for a vehicle, comprising: providing vacuum via at least one vehicle vacuum source solely to a first actuator group when a pressure of a first vacuum reservoir is greater than a first threshold pressure; and providing vacuum via the at least one vehicle vacuum source to the first actuator group and a second actuator group when the pressure of the first vacuum reservoir is less than the first threshold pressure.

Operation of a vacuum system comprised of a plurality of vacuum consumers can be improved by prioritizing the use of vacuum between the various vacuum consumers. For example, assisting an operator to apply vehicle brakes via a brake booster may have higher vacuum use priority over operating a vehicle ventilation system. By making vacuum available to higher priority vacuum consumers and limiting vacuum available to lower priority vacuum consumers, higher priority vacuum consumers may operate for longer time periods when sources for producing vacuum may be limited. Further, the vacuum production capacity of vacuum sources may be applied solely to higher priority vacuum consumers rather than all vacuum consumers. In this way, operation of higher priority vacuum operated actuators may be improved.

The present description may provide several advantages. In particular, the approach may allow higher priority vacuum operated actuators to operate for longer periods of time when vacuum is not being generated by an engine of a vehicle. Further, the approach may improve the utility of vacuum produced during times of low vacuum availability. Further still, the approach can also limit the use of vacuum between secondary vacuum consumers so as to conserve vacuum between lower priority vacuum consumers.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
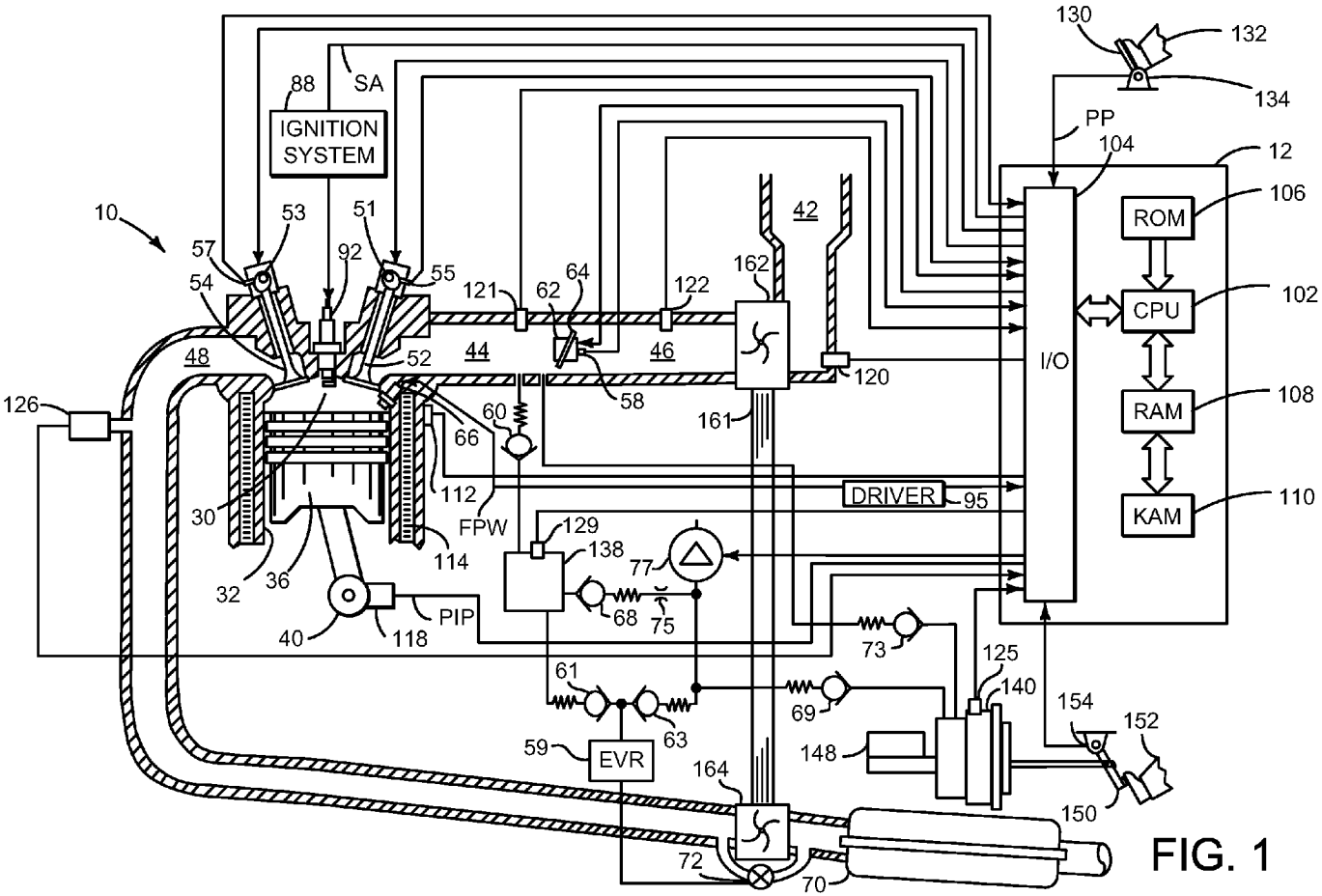
FIG. 1 shows a schematic depiction of an engine and vacuum system.
Figure 2:
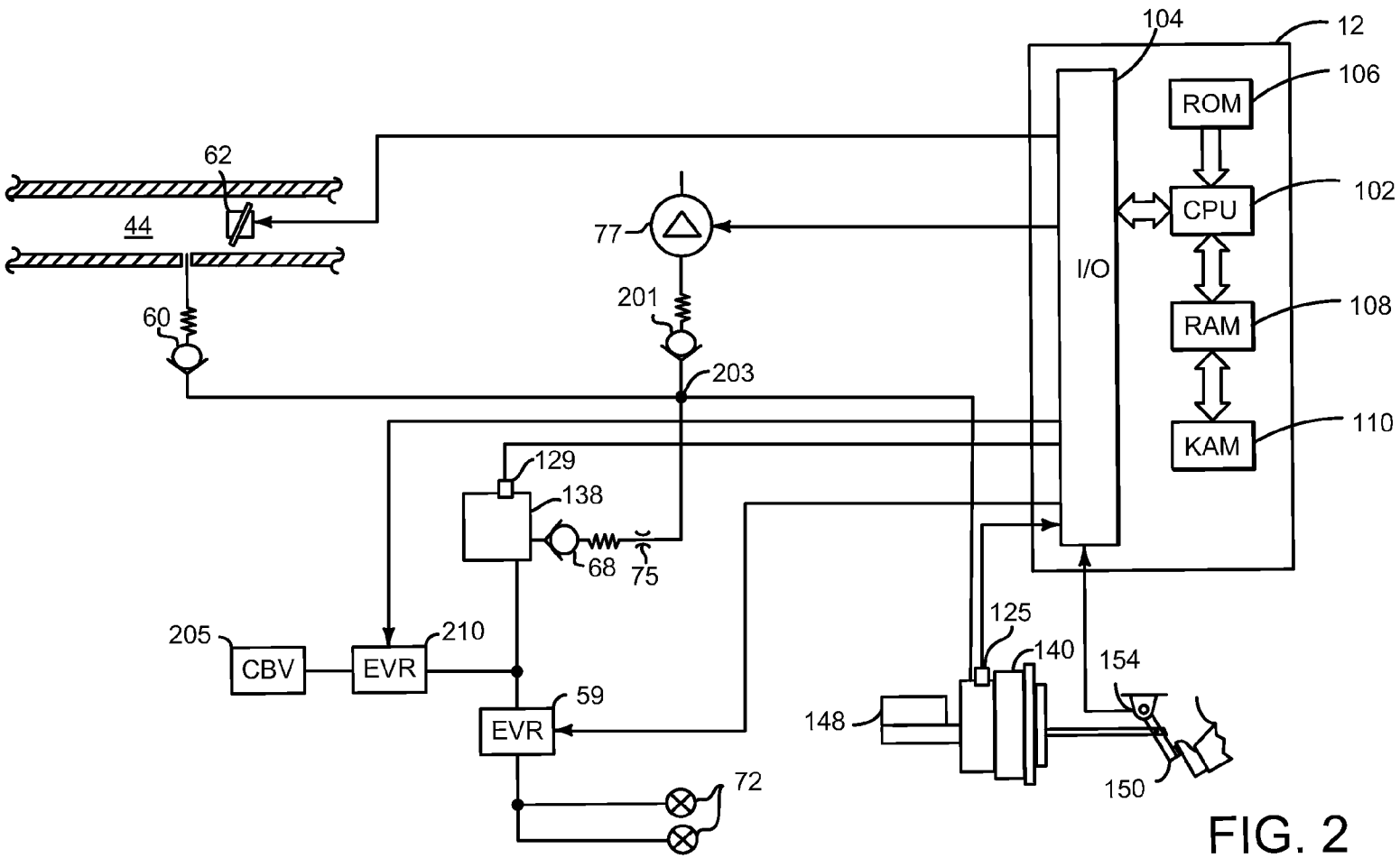
FIGS. 2-4 show schematic depictions of alternative vacuum systems.
Figure 3:
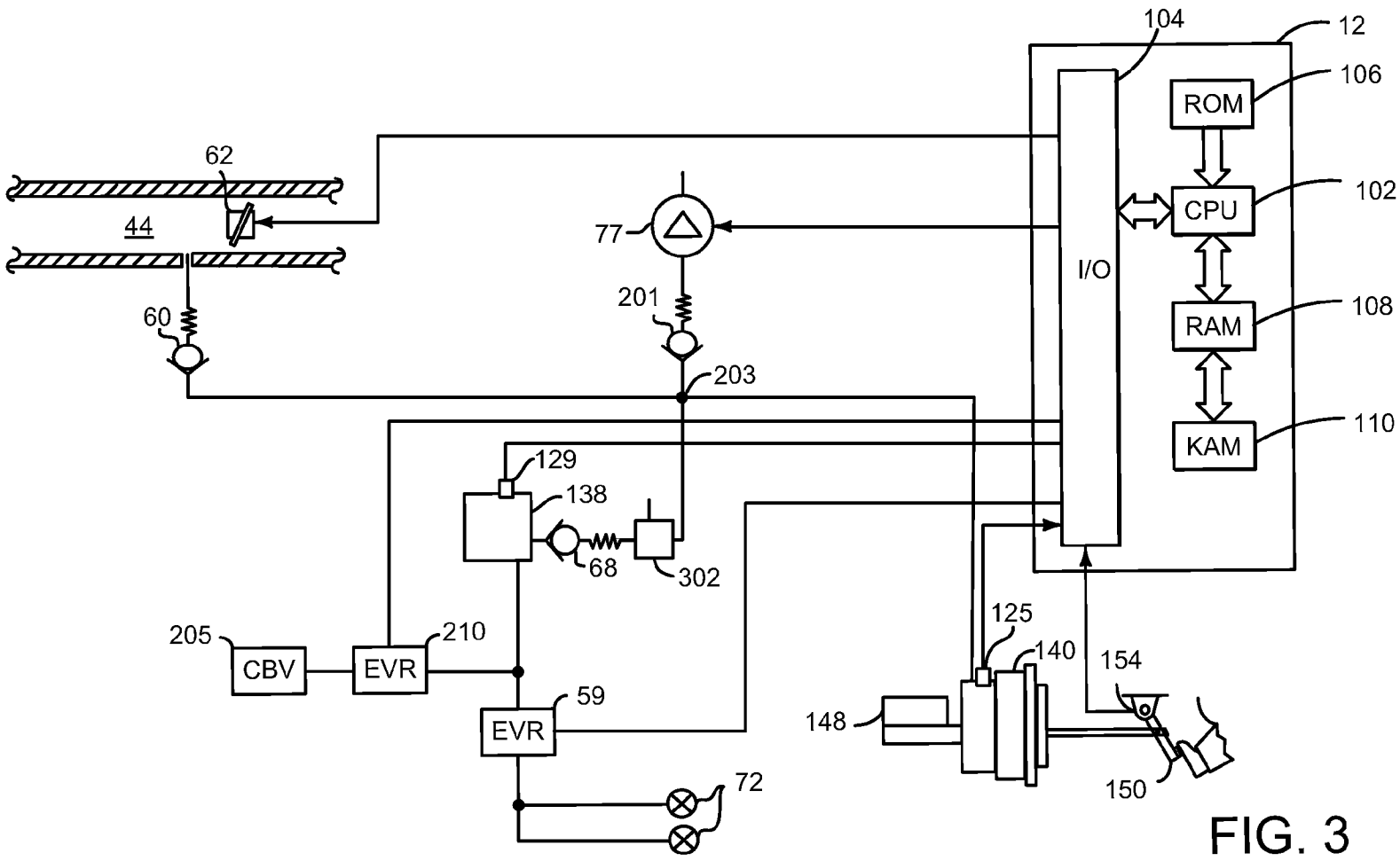
Figure 4:
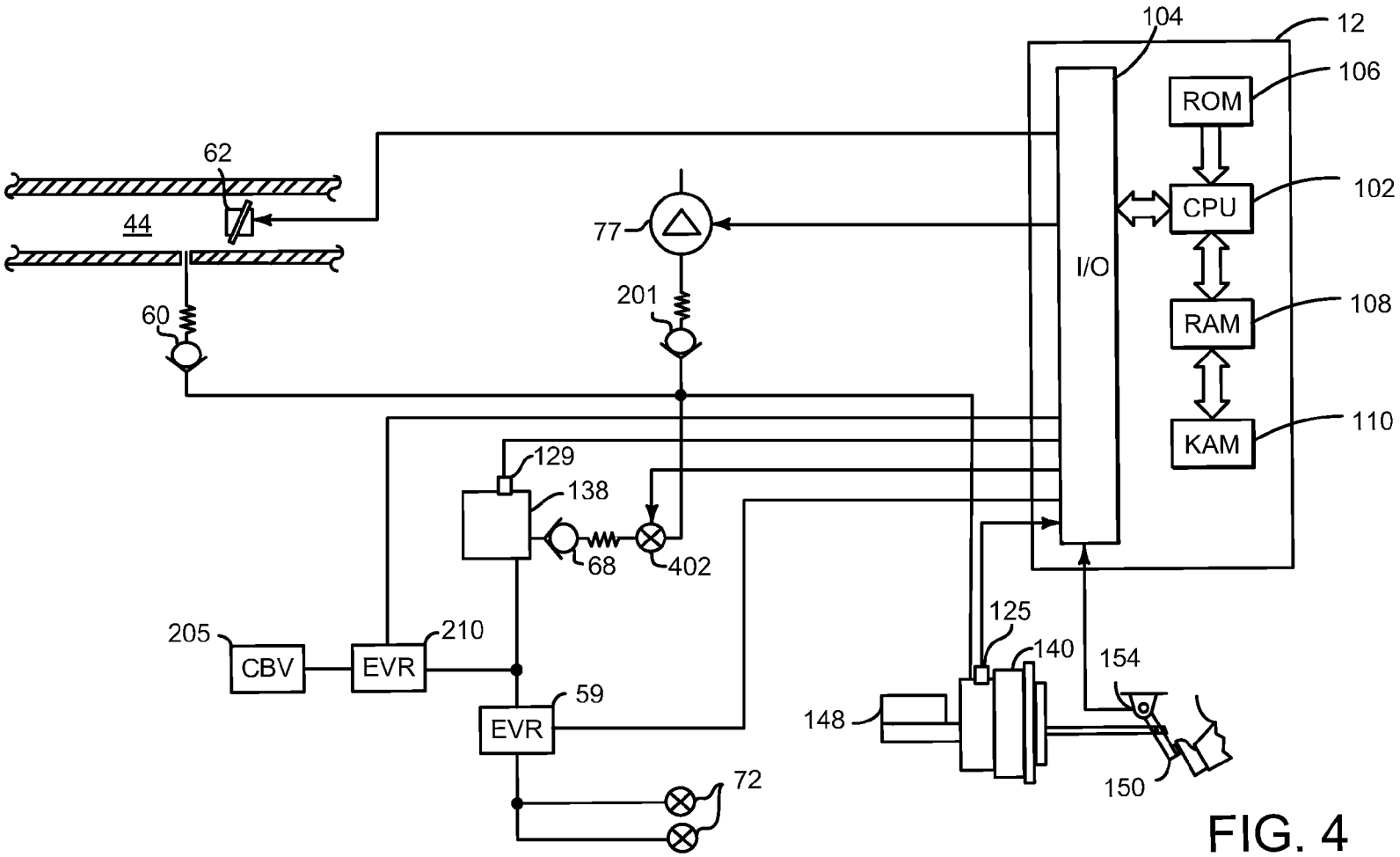
Figure 5:
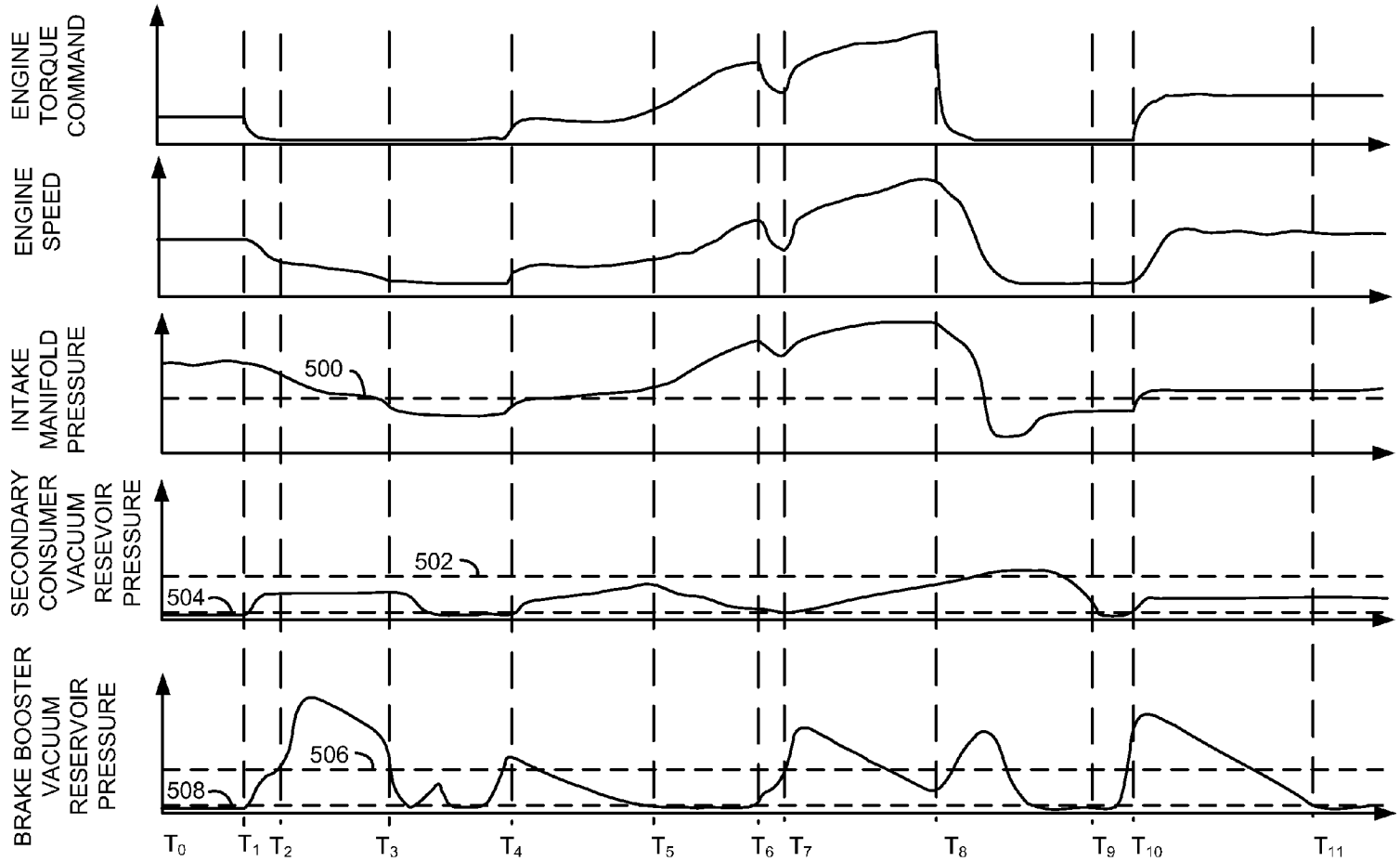
FIGS. 5-6 show signals of interest during a prophetic vehicle drive cycle.
Figure 6:
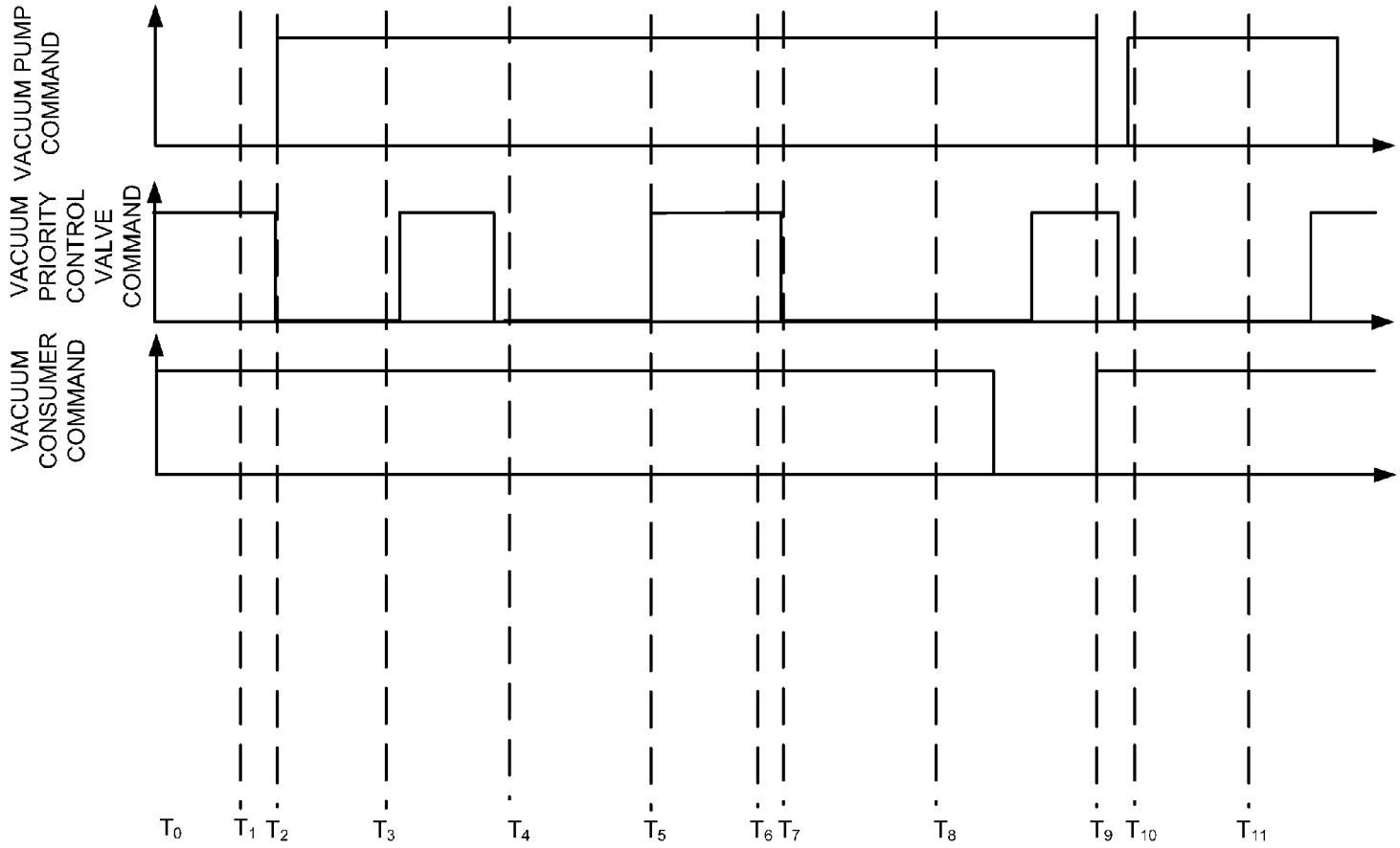
Figure 7:
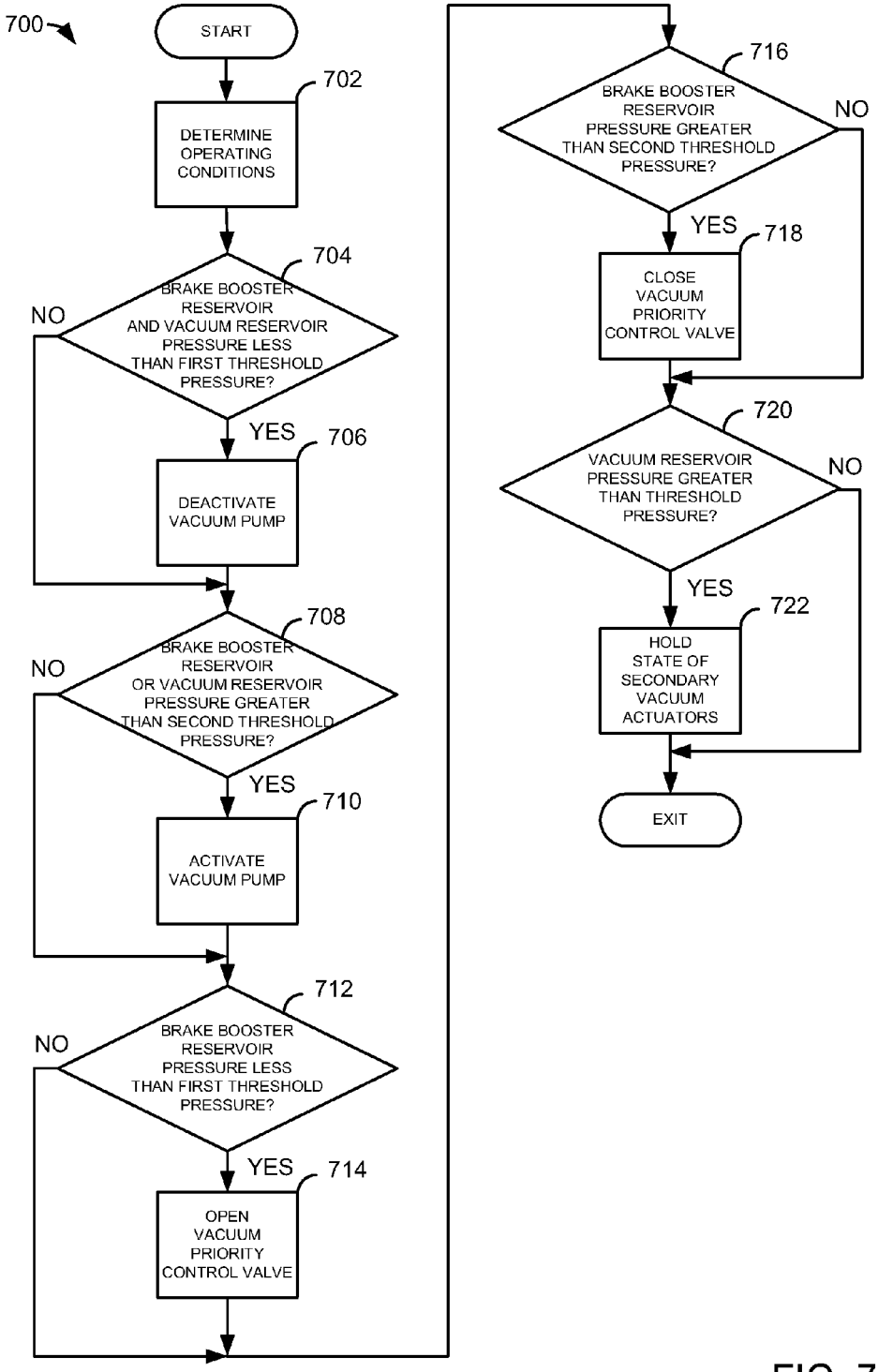
FIG. 7 shows a high level flowchart of a method for prioritizing vacuum within a vehicle vacuum system.

The present description is related to providing vacuum to assists in actuator operation. FIG. 1 shows one example embodiment for providing vacuum to a vehicle vacuum system. FIGS. 2-4 show schematic depictions of alternative vacuum systems absent the detailed engine assembly shown in FIG. 1. FIGS. 5 and 6 show prophetic signals of interest when operating a vehicle that has the capability of prioritizing vacuum of a vacuum system. FIG. 7 shows a method for prioritizing vacuum for a vehicle.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 95 which responds to controller 12. In addition, intake manifold 44 is shown communicating with optional electronic throttle 62 which adjusts a position of throttle plate 64 to control air flow from intake boost chamber 46.

Compressor 162 draws air from air intake 42 to supply boost chamber 46. Exhaust gases spin turbine 164 which is coupled to compressor 162 via shaft 161. Vacuum operated waste gate actuator 72 allows exhaust gases to bypass turbine 164 so that boost pressure can be controlled under varying operating conditions. Vacuum is supplied to waste gate actuator 72 from secondary vacuum consumer vacuum reservoir 138 or vacuum pump 77 via electronic vacuum regulator (EVR) 59, check valve 61, and check valve 63. The EVR may be a regulator that applies vacuum or venting based on a duty cycle applied to the regulator. Alternatively, the EVR may be comprised of two valves, one valve controlling the connection to vacuum and one controlling connection to vent. In this way, the EVR controls the position of the waste gate actuator.

Vacuum pump 77 may be selectively operated via a control signal from controller 12. Check valve 61 allows air to flow to secondary vacuum consumer vacuum reservoir 138 from EVR 59 and limits air flow to EVR 59 from secondary vacuum consumer vacuum reservoir 138. Check valve 63 allows air to flow to vacuum pump 77 from EVR 59 and limits air flow to EVR 59 from vacuum pump 77. Secondary vacuum consumer vacuum reservoir 138 may be supplied vacuum from intake manifold 44 via check valve 60 or vacuum pump 77 via check valve 68 and orifice 75. Orifice 75 may be used to restrict air flow from reservoir 138. If reservoir 138 is restricted in this way, check valve 63 gives EVR 59 immediate access to any available vacuum source. Check valve 60 allows air to flow from secondary vacuum consumer vacuum reservoir 138 to intake manifold 44 and limits air flow from intake manifold 44 to secondary vacuum consumer vacuum reservoir 138. Orifice 75 limits air flow from secondary vacuum consumer vacuum reservoir 138 to vacuum pump 77 so that brake booster 140 may be supplied a higher fraction of vacuum produced by vacuum pump 77. Check valve 68 allows air to flow from secondary vacuum consumer vacuum reservoir 138 to vacuum pump 77 and limits air flow from vacuum pump 77 to secondary vacuum consumer vacuum reservoir 138.

Brake booster 140, including a brake booster reservoir, may be supplied vacuum from intake manifold 44 via check valve 73. Check valve 73 allows air to flow to intake manifold 44 from brake booster 140 and limits air flow to brake booster 140 from intake manifold 44. Check valves 73 and 60 accommodate fast pull down of the reservoir pressures when reservoir (e.g., 138 and 140) pressure is relatively high and intake manifold pressure is low. Brake booster 140 may also be supplied vacuum from vacuum pump 77 via check valve 69. Check valve 69 allows air to flow to vacuum pump 77 from brake booster 140 and limits air flow to brake booster 140 from vacuum pump 77. Check valve 63 may be configured to open at a higher differential pressure than check valve 69 so that the brake booster is supplied vacuum before EVR 59. Thus, the check valves may also be selected to prioritize vacuum provided from vacuum sources to primary and secondary vacuum consumers.

Secondary vacuum consumer vacuum reservoir 138 may also provide vacuum to other secondary vacuum consumers (e.g., heating and ventilation actuators, driveline actuators such as four wheel drive actuators, fuel vapor purging systems, engine crankcase ventilation, and fuel system leak testing systems). Brake booster 140 may include an internal vacuum reservoir, and it may amplify force provided by foot 152 via brake pedal 150 to master cylinder 148 for applying vehicle brakes (not shown).

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands EVR 59 among other actuators. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a position sensor 154 coupled to brake pedal 150 for sensing brake pedal position; a knock sensor for determining ignition of end gases (not shown); a measurement of engine manifold pressure (MAP) from pressure sensor 121 coupled to intake manifold 44; a measurement of boost pressure from pressure sensor 122 coupled to boost chamber 46; brake booster reservoir pressure from pressure sensor 125, vacuum reservoir pressure from pressure sensor 129; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

FIGS. 2-4 are alternative examples of systems for prioritizing use of vacuum between multiple vacuum consumers. For the sake of simplicity and brevity, selected engine components shown in FIG. 1 are omitted from FIGS. 2-4. However, the systems of FIGS. 2-4 are anticipated to operate with an engine as shown in FIG. 1. Further, components shown in FIGS. 2-4 having the same numerical identifiers as shown in FIG. 1 are to be considered to be the same elements as shown in FIG. 1. Therefore, the description of such elements is omitted for the sake of brevity. Likewise, the components of FIGS. 3 and 4 that are illustrated with the same numerical identifiers shown in FIG. 2 are to be considered to be the same elements shown in FIG. 2.

Referring now to FIG. 2, an alternative example system for prioritizing vacuum within a vehicle vacuum system is shown. Vacuum may be supplied to a vacuum reservoir in brake booster 140 and secondary vacuum consumer vacuum reservoir 138 via intake manifold 44 and/or vacuum pump 77. Check valve 201 allows air to flow from a vacuum reservoir in brake booster 140 or from secondary vacuum consumer vacuum reservoir 138. Check valve 201 limits air flow from vacuum pump 77 to secondary vacuum consumer vacuum reservoir 138 and the vacuum reservoir in brake booster 140. When a pressure of intake manifold 44 is lower than a pressure of the vacuum reservoir in brake booster 140 or a pressure in secondary vacuum consumer vacuum reservoir 138, check valve 60 allows air to flow into intake manifold 44 from one of secondary vacuum consumer vacuum reservoir 138 and the vacuum reservoir of brake booster 140.

Check valve 60, check valve 201, the vacuum reservoir in brake booster 140, and secondary vacuum consumer vacuum reservoir 138 are connected at pressure node 203. Further, the vacuum reservoir in brake booster 140 is directly connected to pressure node 203 without any intermediate devices. Consequently, the pressure in the vacuum reservoir of brake booster 140 is substantially equivalent to the pressure at pressure node 203. In contrast, a pressure differential may exist between pressure node 203 and secondary vacuum consumer vacuum reservoir 138 since pressure node 203 and secondary vacuum consumer vacuum reservoir 138 are separated by orifice 75 and check valve 68.

Orifice 75 and check valve 68 act to prioritize the use of vacuum that may be provided via vacuum pump 77 and intake manifold 44. In particular, the amount of vacuum available to evacuate air from secondary vacuum consumer vacuum reservoir 138 is limited by the air flow through orifice 75. Orifice 75 is sized such that no matter the pressure differential across orifice 75, the flow rate through orifice 75 is less than half the air flow capacity of vacuum pump 77 when vacuum pump 77 is operating. Consequently, the vacuum reservoir of brake booster 140 has access to a higher percentage of vacuum supplied to pressure node 203 via vacuum pump 77 than does vacuum consumer vacuum reservoir 138. Similarly, orifice 75 limits the rate of pressure reduction of secondary vacuum consumer vacuum reservoir 138 when intake manifold 44 is at a lower pressure than pressure node 203. In this way, orifice 75 makes the vacuum reservoir in brake booster 140 a higher priority user of vacuum provided by vacuum pump 77 and intake manifold 44.

Controller 12 also can set the priority of vacuum use from secondary vacuum consumer vacuum reservoir 138. For example, if the pressure of secondary vacuum consumer vacuum reservoir 138 is greater than a first threshold pressure and less than a second threshold pressure, controller 12 may allow EVR 210 and EVR 59 to adjust pressures supplied to turbocharger compressor bypass valve (CBV) 205 and waste gate actuators 72. EVR 210 may be integrated with CBV 205 to provide an electrically commanded vacuum operated CBV. In one example, the CBV may include a piloted valve so that the electrical actuation force is amplified pneumatically. On the other hand, if the pressure of secondary vacuum consumer vacuum reservoir 138 is greater than the first and second threshold pressures, controller 12 may allow EVR 210 to adjust pressure supplied to CBV 205 while holding the present amount of vacuum supplied to waste gate actuators 72 to hold the state of turbocharger waste gates.

Referring now to FIG. 3, an alternative example system for prioritizing vacuum within a vehicle vacuum system is shown. The example system of FIG. 3 is the same as the system described in FIG. 2 except that the system of FIG. 3 includes a pneumatic valve 302 rather than orifice 75. Further, controller 12 can prioritize the use of vacuum from secondary vacuum consumer vacuum reservoir 138 as described in FIG. 2.

Pneumatic valve 302 is referenced to atmospheric pressure and allows air flow from secondary vacuum consumer vacuum reservoir 138 to pressure node 203 when pressure at node 203 is less than a predetermined pressure. Thus, the vacuum reservoir of brake booster 140 is allocated use of vacuum without interference from secondary vacuum consumer vacuum reservoir 138, EVR 210, and EVR 59 when vacuum is limited at pressure node 203. In particular, pressure in brake booster 140 may be reduced while pressure at the vacuum consumer vacuum reservoir 138 stays constant or increases. In this way, pneumatic valve 302 controls the priority of vacuum use within the vacuum system. In particular, brake booster 140 has higher priority for vacuum that is produced via vacuum pump 77 and intake manifold 44 when pressure at pressure node 203 is greater than a predetermined value. It should be noted that the pressure threshold at pressure node 203 may be adjusted for different operating conditions such as different ambient barometric pressures.

Referring now to FIG. 4, an alternative example system for prioritizing vacuum with a vehicle vacuum system is shown. The example system of FIG. 4 is the same as the system described in FIG. 2 except that the system of FIG. 4 includes an electrically controlled valve 402 rather than orifice 75. Further, controller 12 can prioritize the use of vacuum from secondary vacuum consumer vacuum reservoir 138 as described in FIG. 2.

Electrically actuated valve 402 may be selectively operated via an electrical signal from controller 12. In one example, controller 12 includes instructions for closing electrically actuated valve 402 when a pressure in the vacuum reservoir of brake booster 140 is greater than a predetermined amount. In other examples, electrically actuated valve 402 may be closed when a rate of pressure change within the vacuum reservoir of brake booster 140 exceeds a predetermined amount. Thus, similar to the pneumatic valve illustrated in FIG. 3, the electrically actuated valve of FIG. 4 can provide priority of vacuum supplied via vacuum pump 77 and intake manifold 44 to brake booster 140 during conditions when pressure at pressure node 203 and the vacuum reservoir of brake booster 140 is greater than a threshold level. Further, controller 12 may include instructions for adjusting the pressure threshold at which electrically actuated valve 402 closes.

In an alternative example, the system of FIG. 4 includes a check valve positioned between the intake manifold 44 and reservoir 138. The check valve is biased to allow for fast pressure pull down in the case where intake manifold pressure is low.

Referring now to FIGS. 5 and 6, simulated signals of interest during engine operation are shown. Vertical markers $T_0$-$T_{11}$ identify particular times of interest during the operating sequence. The signals of FIG. 5 and the signals of FIG. 6 are signals of a same operating sequence. Thus, times $T_0$-$T_{11}$ of FIG. 5 and FIG. 6 are the identical times. In addition, the signals of FIGS. 5-6 may be provided by the system shown in FIG. 4.

The first plot from the top of FIG. 5 shows an engine torque command signal versus time. Time starts at the left side of the plot and increases to the right. The engine torque command signal is at its lowest value at the bottom of the plot and it increases in magnitude toward the top of the plot. A lower torque command provides for a lower engine output torque. A higher torque command provides for a higher engine output torque.

The second plot from the top of FIG. 5 shows engine speed versus time. Time starts at the left side of the plot and increases to the right. Engine speed is at its lowest value at the bottom of the plot and increases toward the top of the plot.

The third plot from the top of FIG. 5 shows engine intake manifold pressure versus time (e.g., intake manifold 44 of FIG. 4). Time starts at the left side of the plot and increases to the right. Engine intake manifold pressure increases in the direction of the Y-axis arrow. Horizontal marker 500 represents atmospheric pressure in the third plot. Thus, when manifold pressure is above marker 500, the intake manifold is at a positive pressure. When manifold pressure is below marker 500 the intake manifold is at a vacuum.

The fourth plot from the top of FIG. 5 shows secondary vacuum consumer vacuum reservoir pressure versus time (e.g., secondary vacuum consumer vacuum reservoir 138 of FIG. 4). Time starts at the left side of the plot and increases to the right. Horizontal marker 502 represents a second threshold level of vacuum reservoir pressure. Horizontal marker 504 represents a first threshold level of vacuum reservoir pressure. Vacuum reservoir vacuum is at a higher level of vacuum at the bottom of the plot.

The fifth plot from the top of FIG. 5 shows brake booster vacuum reservoir pressure versus time (e.g., brake booster 140 of FIG. 4). Time starts at the left side of the plot and increases to the right. Horizontal marker 506 represents a second threshold level of vacuum reservoir pressure. Horizontal marker 508 represents a first threshold level of vacuum reservoir pressure. Brake booster vacuum reservoir vacuum is at a higher level of vacuum at the bottom of the plot.

The first plot from the top of FIG. 6 shows vacuum pump activation command. The vacuum pump (e.g., vacuum pump 77 of FIG. 4) is commanded on when the vacuum pump activation command is near the top of the first plot. The vacuum pump is commanded off when the vacuum pump activation command is near the bottom of the first plot.

The second plot from the top of FIG. 6 shows a vacuum priority control valve command. The vacuum priority control valve (e.g., electrically actuated valve 402 of FIG. 4) is commanded open when the vacuum priority control valve command is near the top of the second plot. The vacuum priority control valve is commanded closed when the vacuum priority control valve is command is near the bottom of the second plot.

The third plot from the top of FIG. 6 shows a vacuum consumer command. The vacuum consumer command represents a signal for limiting use of vacuum by vacuum consumers other than the primary (e.g., brake booster and other selected vacuum consumers) vacuum consumers. Vacuum consumers may include but are not limited to waste gate actuators, heating and ventilation actuators, fuel vapor purging systems, drivetrain actuators, engine crankcase ventilation, and leak check systems. When the vacuum consumer command is near the top of the plot, vacuum consumers may use as much vacuum as they desire. When the vacuum consumer command is near the bottom of the plot, selected vacuum consumers may be held in their present operating state so that vacuum is conserved.

It should be noted that intake manifold pressure and vacuum reservoir pressure are not plotted to the same scale. For example, the units of the Y axis of the intake manifold pressure plot are not equivalent to the units of the Y axis of the vacuum reservoir plot.

At time $T_0$, the engine is operating at a low engine torque (e.g., 20% of wide-open-throttle (WOT)). Further, the engine speed is at a medium engine speed (e.g., 2500 RPM), the intake manifold pressure is above atmospheric pressure, pressure in the secondary vacuum consumer vacuum reservoir is less than a first threshold pressure 504, brake booster vacuum reservoir pressure is less than a first threshold pressure 508, the vacuum pump command is off, the vacuum priority control valve is commanded open, and the vacuum consumer command is at a high level so that all vacuum consumers may have access to vacuum.

The vacuum pump command is shown commanding the vacuum pump off because both the secondary vacuum consumer vacuum reservoir and the brake booster vacuum reservoir pressure are less than the first pressure thresholds 504 and 508 respectively. The vacuum priority control valve signal is shown commanding the vacuum priority valve to an open position so that vacuum provided by the intake manifold 44 and the vacuum pump 77 is available throughout the vacuum system. The vacuum consumer command is at a high level so that all vacuum consumers may have access to system vacuum.

At time $T_1$, the engine torque command is reduced from a low level. In some examples, when the engine torque demand is reduced from a low level engine torque demand at relatively low engine speed, the controller reduces intake manifold pressure at a low rate so that the torque reduction is less noticeable to the driver. During such conditions it may take more time for pressure in the intake manifold to fall below atmospheric pressure. The engine speed begins to decrease at $T_1$ since less engine torque is available to rotate the engine. Intake manifold pressure also begins to decrease since less air is needed for a reduced engine torque demand. The secondary vacuum consumer vacuum reservoir pressure begins to increase as vacuum is used to adjust the turbocharger waste gate. In addition, the secondary vacuum consumer vacuum reservoir pressure increase may be related to vacuum consumption by other vacuum consumers (e.g., ventilation system, drivetrain actuators, and CBV actuators). Pressure in the brake booster vacuum reservoir begins to increase shortly after time $T_1$ in response to depression of a brake pedal, for example. The vacuum pump command remains such that the vacuum pump is commanded to an off state. The vacuum priority control valve is commanded to an open state so that air can flow to vacuum sources (e.g., vacuum pump and intake manifold) from secondary vacuum consumers (e.g., vacuum consumers other than the brake booster) if pressure at the vacuum sources is lower than at the secondary vacuum consumer vacuum reservoir (e.g., 138 of FIG. 4).

At time $T_2$, the engine torque command remains low and the engine speed continues to decrease. Further, intake manifold pressure continues to decrease as air is pumped from the engine intake manifold. Pressure in the secondary vacuum consumer vacuum reservoir continues to increase at a relatively slow rate. Pressure in the brake booster vacuum reservoir increases more rapidly and to a higher level as the break pedal is released. In particular, pressure in the brake booster reservoir increases to a level greater than the second pressure threshold 506. A brake booster vacuum reservoir pressure greater than the second pressure threshold 506 causes a controller (e.g., controller 12 of FIG. 4) to command the vacuum pump on. Further, the controller commands the vacuum priority control valve closed so that vacuum from the vacuum pump and the intake manifold is available to only higher priority vacuum consumers (e.g., brake booster). Activating the vacuum pump begins to reduce pressure in the brake booster vacuum reservoir. The vacuum consumer command remains at a high level indicating that vacuum in the secondary vacuum consumer vacuum reservoir is at a level sufficient to continue supplying vacuum to secondary vacuum consumers.

It should be mentioned that in all the examples mentioned, the higher priority vacuum consumers may be comprised of a group of vacuum consumers selected based on system requirements. In some examples, the higher priority group of vacuum consumers may be comprised of two or more vacuum consumers (e.g., brake booster and waste gate actuators). In other examples, the higher priority group of vacuum consumers may be comprised of a single vacuum consumer (e.g., brake booster).

At time $T_3$, the engine torque command and engine speed are at relatively low levels. Further, the intake manifold pressure has been reduced to a pressure less than atmospheric pressure. In some examples, pressure in the engine intake manifold may be decreased by increasing engine speed, shifting gears, throttling the engine, and/or discarding engine loads in response to a pressure in the vacuum system greater than a predetermined pressure. When the intake manifold pressure is less than the pressure in the vacuum system at the vacuum reservoir in the brake booster, a check valve opens and allows air to flow into the intake manifold, thereby lowering pressure in the vacuum reservoir in the brake booster. As such, the pressure in the brake booster vacuum reservoir decreases at a more rapid rate since air flows from the brake booster vacuum reservoir to the vacuum pump and the intake manifold. Since the engine has a large displacement relative to the vacuum pump, it is possible for the engine to draw air at much higher rates than the vacuum pump during some conditions. The vacuum pump remains on at time $T_3$, and the vacuum priority control valve remains closed so that vacuum from the intake manifold and the vacuum pump is available solely to primary vacuum consumers. However, shortly after time $T_3$, the vacuum priority control valve is commanded to an open state so that vacuum provided by the intake manifold and the vacuum pump is made available to secondary vacuum consumers. The vacuum priority control valve is commanded open in response to pressure in the brake booster vacuum reservoir reaching the first pressure threshold 508. When the vacuum priority control valve is opened, pressure in the secondary vacuum consumer vacuum reservoir which supplies vacuum to secondary vacuum consumers is lowered since vacuum from the intake manifold and the vacuum pump is made available to the secondary vacuum consumer vacuum reservoir. Shortly before time $T_4$, the vehicle brake is released causing pressure in the brake booster vacuum reservoir to increase above the second pressure threshold 506. The vacuum priority control valve closes in response to pressure in the brake booster vacuum reservoir exceeding the second pressure threshold 506.

At time $T_4$, the engine torque command increases and engine speed follows the increase in engine torque. Intake manifold pressure also increases in response to the greater torque demand. Pressure in the brake booster vacuum reservoir is gradually reduced by the activated vacuum pump. Since pressure in the intake manifold is greater than the pressure in the brake booster, the intake manifold does not reduce brake booster vacuum reservoir pressure. Pressure in the secondary vacuum consumer vacuum reservoir gradually increases since the secondary vacuum consumer vacuum reservoir is isolated from intake manifold and vacuum pump vacuum sources via the vacuum priority control valve and since vacuum within the secondary vacuum consumer vacuum reservoir is consumed by secondary vacuum consumers (e.g., waste gate actuators, ventilation controls, and CBV). The vacuum consumer command remains at a high level since vacuum in the secondary vacuum consumer vacuum reservoir remains below the second vacuum reservoir pressure threshold 502. Therefore, all secondary consumers have access to vacuum in the secondary vacuum consumer vacuum reservoir.

At time $T_5$, pressure in the brake booster vacuum reservoir is reduced to less than the first brake booster vacuum reservoir pressure threshold. In addition, the vacuum priority control valve is commanded to an open state so that the secondary vacuum consumer vacuum reservoir can be supplied vacuum from the vacuum pump and intake manifold. Pressure in the secondary vacuum consumer vacuum reservoir is shown gradually increasing until the vacuum priority control valve is opened at time $T_5$.

At time $T_6$, the engine torque command and engine speed are briefly reduced. The intake manifold pressure is also reduced as air is pumped from the intake manifold; however, pressure in the intake manifold remains above atmospheric pressure so that vacuum may not be supplied by the intake manifold. Pressure in the secondary vacuum consumer vacuum reservoir is near the first secondary vacuum consumer vacuum reservoir pressure threshold but does not fall below the first secondary vacuum consumer vacuum reservoir pressure threshold. Further, pressure in the brake booster vacuum reservoir increases as the vehicle brake is applied.

At time $T_7$, the vehicle brake pedal is released and the engine torque command is increased. Engine speed increases with the increased engine torque demand and intake manifold pressure also increases with the increased engine torque demand. Pressure in the brake booster vacuum reservoir increases to a level above the second brake booster vacuum reservoir pressure threshold when the brake pedal is released. Further, the vacuum priority control valve is commanded to a closed position so that vacuum from the vacuum pump and intake manifold is available solely to primary vacuum consumers. Pressure in the secondary vacuum consumer vacuum reservoir begins to increase after time $T_7$ in response to secondary vacuum consumers using vacuum from the secondary vacuum consumer vacuum reservoir. Pressure in the brake booster vacuum reservoir increases after the vehicle brake is released and then begins to decrease as the vacuum pump evacuates air from the brake booster vacuum reservoir.

At time $T_8$, the engine torque command is reduced relatively quickly from a higher engine torque demand. The engine speed also begins to decline after the engine torque demand is reduced. When engine torque is reduced during such conditions, the engine controller can evacuate air from the intake manifold at a higher rate so that the vehicle decelerates at a desired rate. In this example, the intake manifold pressure is initially reduced at a first rate and then further reduced at a second rate when application of the vehicle brake causes pressure in the brake booster vacuum reservoir to increase to a level above the second brake booster vacuum reservoir pressure threshold at 506. Pressure in the brake booster vacuum reservoir is reduced by the vacuum pump, but the rate of pressure reduction within the brake booster increases when pressure in the intake manifold falls below brake booster pressure. Pressure within the secondary vacuum consumer vacuum reservoir continues to increase at time $T_8$ since vacuum consumption by secondary vacuum continues and since the vacuum priority control valve remains in a closed position.

Between time $T_8$ and time $T_9$, pressure in the secondary vacuum consumer vacuum reservoir increases to a level greater than the second secondary vacuum consumer vacuum reservoir pressure threshold. During such conditions, vacuum use for secondary vacuum consumers that may be isolated from vacuum sources via the vacuum priority control valve may be prioritized by the vacuum controller. In one example, secondary vacuum consumers that have less priority over other secondary vacuum consumers are held in their present operating state to conserve vacuum in the vacuum reservoir. The higher priority secondary vacuum consumers may continue to use vacuum from the secondary vacuum consumer vacuum reservoir. The vacuum consumer command goes to a low state to indicate that lower priority vacuum consumers within the secondary vacuum consumer group are to remain or transition to a low vacuum use state.

Pressure in the brake booster vacuum reservoir also increases just after time $T_8$ in response to application of vehicle brakes, and then pressure decreases to a level below the first brake booster vacuum reservoir pressure threshold as the pressure is reduce via the vacuum pump and the intake manifold. As a result, the vacuum priority control valve is opened so that the secondary vacuum consumer vacuum reservoir and secondary vacuum consumers may be put in communication with intake manifold and vacuum pump vacuum sources. Opening the vacuum priority control valve allows pressure in the secondary vacuum consumer vacuum reservoir to fall below the second vacuum reservoir pressure threshold so that vacuum is not prioritized between vacuum consumers of the secondary vacuum consumer group.

At time $T_9$, pressure in the secondary vacuum consumer vacuum reservoir is reduced to a level less than the first secondary vacuum consumer vacuum reservoir pressure threshold. Further, since pressure in the brake booster vacuum reservoir is less than the first brake booster vacuum reservoir pressure threshold. Consequently, the vacuum pump is deactivated to reduce engine fuel consumption. In addition, the vacuum consumer command is returned to a high level at time $T_9$.

Shortly after time $T_9$, the vehicle brakes are released and pressure within the brake booster vacuum reservoir increases to a level above the second brake booster vacuum reservoir pressure threshold. Therefore, in response to the pressure in the brake booster vacuum reservoir being above the second brake booster vacuum threshold, the vacuum priority control valve commands the vacuum priority control valve to a closed position and the vacuum pump is reactivated. As such, the secondary vacuum consumers are isolated from the intake manifold and vacuum pump vacuum sources.

At time $T_{10}$, engine torque is increased and engine speed increases with the increased engine torque demand. Intake manifold pressure also increases so that the engine torque demand may be met. Pressure in the vacuum reservoir also increases as secondary vacuum consumers such as waste gate actuators consume vacuum from the vacuum reservoir.

At time $T_{11}$, pressure in the brake booster vacuum reservoir has been reduced by the vacuum pump to less than the first brake booster vacuum reservoir pressure threshold. Consequently, the vacuum priority control valve command goes to a high level so that secondary vacuum consumers may be put in communication with intake manifold and vacuum pump vacuum sources.

Thus, FIGS. 5 and 6 show signals from an example operating sequence. The signals of FIGS. 5 and 6 may be provided by the method of FIG. 7 executed within controller 12 of FIG. 4. The systems of FIGS. 1-3 may have signals similar to those of FIGS. 5 and 6 with the exception of the vacuum priority control valve command.

Referring now to FIG. 7, a method for prioritizing vacuum within a vehicle vacuum system is shown. The method of FIG. 7 may be executed by a controller 12 of FIGS. 1-4.

At 702, method 700 determines operating conditions. In one example, operating conditions may include but are not limited to engine speed, engine torque demand, secondary vacuum consumer vacuum reservoir pressure, brake booster vacuum reservoir pressure, intake manifold pressure, and ambient pressure. Method 700 proceeds to 704 after operating conditions are determined.

At 704, method 700 judges whether or not brake booster vacuum reservoir and secondary vacuum consumer vacuum reservoir pressure are less than a first threshold pressure. In some examples, the first threshold pressure may vary with operating conditions. For example, the first threshold pressure may increase for decreasing ambient pressure. If method 700 judges that brake booster vacuum reservoir pressure and secondary vacuum consumer vacuum reservoir pressure are less than the first threshold pressure, method 700 proceeds to 706. Otherwise, method 700 proceeds to 708.

At 706, method 700 deactivates a vacuum pump of the vacuum system. In one example, the vacuum pump may be deactivated via commanding a relay to an open state. Method 700 proceeds to 708 after the vacuum pump is deactivated.

At 708, method 700 judges whether or not brake booster vacuum reservoir pressure or secondary vacuum consumer vacuum reservoir pressure are greater than a second threshold pressure. In some examples, the second threshold pressure may vary with operating conditions. For example, the second threshold pressure may increase for decreasing ambient pressure. If method 700 judges that brake booster vacuum reservoir pressure or secondary vacuum consumer vacuum reservoir pressure is greater than the second threshold pressure, method 700 proceeds to 710. Otherwise, method 700 proceeds to 712.

At 710, method 710 activates the vacuum pump of the vacuum system. In one example, the vacuum pump may be activated by commanding a relay to a closed state. Method 700 proceeds to 712 after the vacuum pump is deactivated.

At 712, method 700 judges whether or not brake booster vacuum reservoir pressure is less than a first brake booster vacuum reservoir threshold pressure. If so, method 700 proceeds to 714. Otherwise, method 700 proceeds to 716.

At 714, method 700 opens a vacuum priority control valve. In one example, the vacuum priority control valve is placed in a conduit that couples the secondary vacuum consumer vacuum reservoir to the brake booster vacuum reservoir and the vacuum sources (e.g., vacuum pump and/or engine intake manifold). The system of FIG. 4 shows one example system configuration where vacuum priority control valve 402 controls air flow from the secondary vacuum consumer vacuum reservoir to the brake booster vacuum reservoir, intake manifold, and vacuum pump. The vacuum priority control valve may be opened via an electric signal. Method 700 proceeds to 716 after the vacuum priority control valve is opened.

At 716, method 700 judges whether or not brake booster reservoir pressure is greater than a second threshold pressure. If so, method 700 proceeds to 718. Otherwise, method 700 proceeds to 720.

At 718, method 700 closes the vacuum priority control valve to isolate the secondary vacuum consumers vacuum reservoir and secondary vacuum consumers from the vacuum sources and the brake booster vacuum reservoir. In one example, the vacuum priority control valve can be closed via an electrical signal from a controller (e.g., controller 12 of FIG. 4). Method 700 proceeds to 720 after the vacuum priority control valve is closed.

At 720, method 700 judges whether or not secondary vacuum consumer vacuum reservoir pressure is greater than a second threshold pressure. If so, method 700 proceeds to 722. Otherwise, method 700 proceeds to exit.

At 722, method 700 holds the state of selected secondary vacuum consumers or adjusts commands to reduce the rate vacuum is consumed by the selected secondary vacuum consumers. The selected secondary vacuum consumers may be a fraction of a group of secondary vacuum consumers. In one example, a group of secondary vacuum consumers is separated into a first and second group of vacuum consumers. The controller continues to adjust a first EVR regulating vacuum supplied to the first group of secondary vacuum consumers while the controller holds the state of a second EVR regulating vacuum supplied to the second group of vacuum consumers. In this way, the controller gives vacuum priority to the first group of vacuum consumers over the second group of vacuum consumers. Method 700 proceeds to exit after prioritizing vacuum use between groups of secondary vacuum consumers.

In an example where a normally open vacuum actuated waste gate is present, it may be desirable to keep the waste gate closed in case of high vacuum reservoir pressure because the waste gate readiness may be more important than fuel economy associated with opening the waste gate to prevent higher turbine speeds.

As will be appreciated by one of ordinary skill in the art, the methods described in FIG. 7 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A vacuum prioritization method for a vehicle, comprising:

providing vacuum via at least one vehicle vacuum source solely to a first actuator group when a pressure of a first vacuum reservoir is greater than a first threshold pressure;

providing vacuum via the at least one vehicle vacuum source to the first actuator group and a second actuator group when the pressure of the first vacuum reservoir is less than the first threshold pressure; and supplying vacuum to the second actuator group via a second vacuum reservoir when the pressure in the first vacuum reservoir is greater than the first threshold pressure.

2. The vacuum prioritization method of claim 1, where the at least one vehicle vacuum source includes an intake manifold of an engine and a vacuum pump or an ejector, where the first actuator group and second actuator group are comprised of vacuum operated actuators, and where the first vacuum reservoir is a brake booster reservoir.

3. The vacuum prioritization method of claim 2, where the vacuum pump is selectively activated in response to the pressure of the first vacuum reservoir.

4. The vacuum prioritization method of claim 1, where air flow between the first vacuum reservoir and the second vacuum reservoir is limited via an orifice or a valve that is controlled in response to the pressure of the first vacuum reservoir.

5. The vacuum prioritization method of claim 1, further comprising holding the second actuator group in an operating state when the pressure in the first vacuum reservoir is greater than the first threshold pressure and when a pressure in the second vacuum reservoir is greater than a second threshold pressure.

6. The vacuum prioritization method of claim 1, further comprising increasing an amount of vacuum supplied to the first vacuum reservoir via adjusting operation of an engine when the pressure of the first vacuum reservoir is greater than the first threshold pressure and when a torque demand of the engine is less than a threshold torque demand.

7. A system for providing vacuum for a vehicle, comprising:

a brake-booster vacuum reservoir;

a secondary vacuum reservoir;

a first vacuum source in communication with the brake-booster and secondary vacuum reservoirs;

a second vacuum source in communication with the brake-booster and secondary vacuum reservoirs; and a device to provide priority to receive vacuum at the brake-booster vacuum reservoir over the secondary vacuum reservoir via the first vacuum source and the second vacuum source.

8. The system of claim 7, where the device is an orifice positioned in a conduit at a location between the brake-booster vacuum reservoir and the secondary vacuum reservoir.

9. The system of claim 7, where the device is a controller including instructions for prioritizing vacuum supplied via the first vacuum source and the second vacuum source to the brake-booster vacuum reservoir and the secondary vacuum reservoir.

10. The system of claim 9, where the first vacuum source is an intake manifold of an engine, and further comprising additional instructions for decreasing a pressure of the intake manifold when a pressure of the brake-booster vacuum reservoir exceeds a first pressure while an engine torque demand is less than a first torque demand.

11. The system of claim 7, where the device is a pneumatically controlled valve.

12. The system of claim 7, where the second vacuum source is a vacuum pump or an ejector.

13. The system of claim 7, where a plurality of vacuum consumers is in communication with the secondary vacuum reservoir and where the device to provide priority to receive vacuum at the brake-booster vacuum reservoir over the secondary vacuum reservoir limits vacuum to the plurality of vacuum consumers.

14. A system for providing vacuum for a vehicle, comprising:

an engine intake system;

a first vacuum reservoir;

a turbocharger with a compressor coupled in the engine intake system;

a second vacuum reservoir pneumatically coupled to the engine intake system;

a first group of vacuum operated actuators in pneumatic communication with the first vacuum reservoir;

a second group of vacuum operated actuators in pneumatic communication with the second vacuum reservoir;

a first vacuum source comprising an engine intake manifold in pneumatic communication with the first vacuum reservoir and the second vacuum reservoir;

a second vacuum source in pneumatic communication with the first vacuum reservoir and the second vacuum reservoir; and a controller configured to limit air flow from the second vacuum reservoir to the first vacuum reservoir, the first vacuum source, and the second vacuum source when a pressure of the first vacuum reservoir is greater than a first threshold pressure.

15. The system of claim 14, where the controller is a pneumatically actuated valve.

16. The system of claim 14, where the controller includes a processor and input and output ports, the system further comprising an electrically operated valve in electrical communication with the controller.

17. The system of claim 16, where the controller includes instructions to close the electrically operated valve when a pressure of the first vacuum reservoir is greater than a first pressure.

18. The system of claim 14, where the first group of vacuum operated actuators includes a brake booster.

19. The system of claim 14, where the second group of vacuum operated actuators includes a compressor bypass valve and a waste gate actuator.

* * * * *